United States Patent [19]

Rigsby

[11] 4,181,339

[45] Jan. 1, 1980

[54] DOOR KNOB STOPPER

[76] Inventor: Randle L. Rigsby, P.O. Box 8934, Anchorage, Ak. 99508

[21] Appl. No.: 908,526

[22] Filed: May 22, 1978

Related U.S. Application Data

[63] Continuation-in-part of Ser. No. 747,058, Dec. 3, 1976, abandoned.

[51] Int. Cl.[2] ..... E05C 21/00

[52] U.S. Cl. ..... 292/347; 292/DIG. 2; 292/336.3

[58] Field of Search ..... 292/DIG. 8, DIG. 2, 292/347, 336.3

[56] References Cited

U.S. PATENT DOCUMENTS

| | | | |
|---|---|---|---|
| 2,131,067 | 9/1938 | Paden | 292/DIG. 8 |
| 3,082,028 | 3/1963 | Werle | 292/DIG. 2 |
| 3,501,187 | 3/1970 | Saksa et al. | 292/347 X |
| 4,000,539 | 1/1977 | Neyer | 292/347 |

*Primary Examiner*—Richard E. Moore

[57] ABSTRACT

A stopper device for being mountable upon a door knob, and which serves as a bumper for limiting the pivotal travel of the door, thereby preventing a hard door knob bumping against a wall and damaging the same, the stopper device being made of a resilient material, such as either acrylic, plastic or rubber, which absorbs the shock upon impact with the wall, in order to not injure the same, the stopper consisting of a sheath that encloses the door knob.

5 Claims, 6 Drawing Figures

DOOR KNOB STOPPER

This is a continuation-in-part of my prior application Ser. No. 747,058, filed Dec. 3, 1976, now abandoned.

This invention relates generally to door stoppers.

It is generally well known to most persons, that, when a conventional door knob bumps against a wall, in time the wall becomes injured by the repeated impact therefrom. Upon occasion, such a door knob will pound a hole through the wall, thus resulting in extensive damage that is costly to repair. This situation is objectionable, and it is, therefore, in want of an improvement.

Accordingly, it is the principal object of the present invention to provide a door knob stopper, which absorbs the shock of a door knob bumping against a wall, so as to prevent the door knob from damaging the same.

Another object of the present invention is to provide a door knob stopper, which can be quickly and easily fitted upon any conventional door knob, and which is much easier to install than a conventional door stopper, such as is mounted upon a floor for abutting against a lower edge of the door, such door stopper being dangerous, because a person may bump thereagainst with his feet, so that the person may possibly hurt himself, or possibly rip the door stop out from the floor or a woodwork, and thus leave an unsightly hole.

Still another object is to provide a door knob stopper, which, accordingly, is located more closely to a longitudinally vertical center of the door instead of the lower edge thereof, so that, upon impact of being stopped, the door does not tend to become twisted, such as occurs when a door is stopped only at a lower edge thereof by a conventional door stopper that is located upon a floor or upon a lower molding of a wall.

Still another object of the present invention is to provide a door knob stopper, which can be very quickly mounted upon the door knob by anyone, without any particular skills, and without the necessity of any special tools.

Still another object is to provide an improved door knob stopper, which additionally includes a cushion upon its outward end, so as to serve as a shock absorber that prevents a full force of a striking door knob being absorbed by the wall.

Still another object is to provide an improved door knob stopper, wherein the cushion is retractable, but which is made rotationally rigid respective to the door knob, so that there is no lost rotational action when the cushion is grasped and rotated, in order to turn the knob.

Other objects are to provide an improved door knob stopper, which is simple in design, inexpensive to manufacture, rugged in construction, easy to use and efficient in operation.

These, and other objects, will be readily evident, upon a study of the following specification, and the accompanying drawing, wherein.

Figure 1:
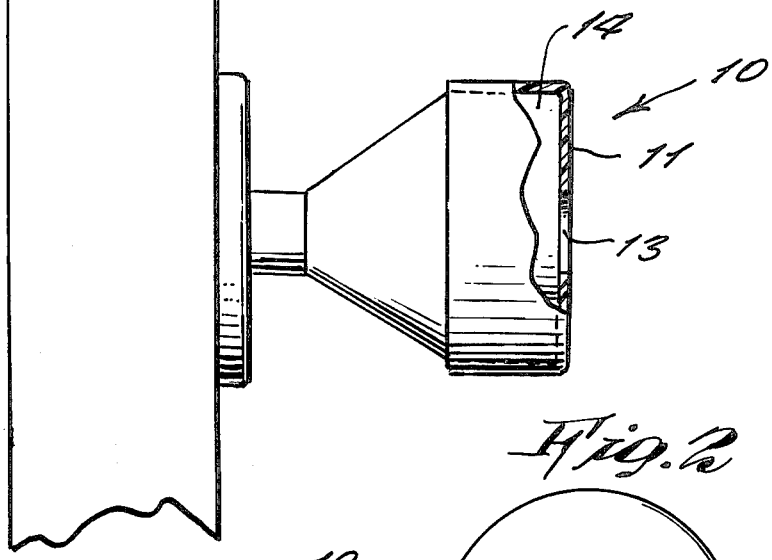
FIG. 1 is a side elevation view of the present invention, shown partly in cross section, and mounted upon a door knob of a door.
Figure 2:
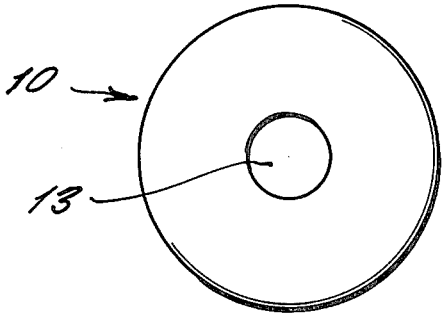
FIG. 2 is a front end view of the door knob stopper.
Figure 3:
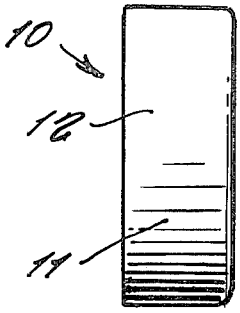
FIG. 3 is a side peripheral view thereof.

Referring now to the drawing in greater detail, and more particularly, to FIGS. 1 through 3 thereof at this time, the reference numeral 10 represents a door knob stopper, according to the present invention, wherein the same comprises a one-piece member that is molded of acrylic plastic, and which may be made either in a silver or a gold color, so that it looks like the conventional color of a door knob that is presently installed upon doors.

The stopper 10 includes a front wall 11 of circular shape, and a peripheral wall 12, which extends around the peripheral edge of the door knob, the peripheral wall edge being integrally formed with the end wall 11.

As shown, a central opening 13 may be provided in certain models of the door knob stopper, the opening 13 providing a clearance for access to push a button on such knobs that have locks located therewithin, and which are conventionally known. While the peripheral wall 12 may be relatively thin, the end wall 11 is preferably thick, so that it gives a cushioning effect upon impact.

In operative use, it is now evident that, when the door knob stopper is mounted upon a door knob 14, the stopper encloses the outer end of the knob, so that the stopper, rather than the door knob, abuts against an object that limits the pivotal travel of the door.

The door knob stopper 10 can be very easily mounted upon the door knob 14, by simply first placing the stopper 10 in a hot water below a boiling point, and which is placed therein for only one-half a minute, in order to allow the door knob stopper to expand. While the stopper is still warm, it is then fitted upon the door knob 14, so that after it cools off, it contracts, and thus snugly fits on the door knob, so that it cannot be very easily removed therefrom, either by vandals or pranksters, and it cannot thus easily fall off.

Figure 4:
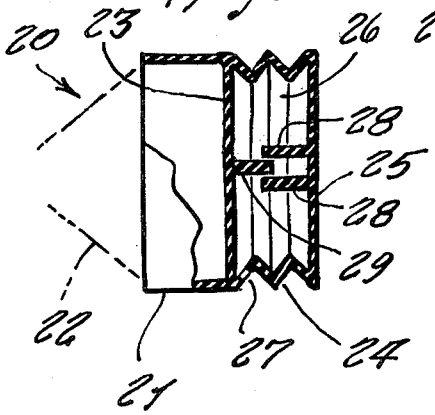
FIG. 4 is a side cross-sectional view of a modified design thereof, and which incorporates additionally a shock absorber.
Figure 5:
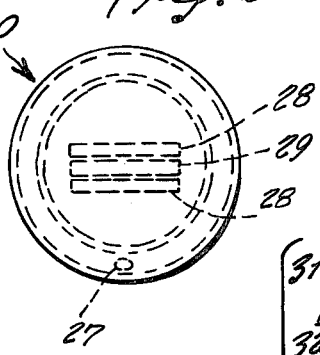
FIG. 5 is a front view thereof.

Referring now to FIGS. 4 and 5 of the drawing, there is shown a modified design of door knob stopper 20, which is preferably made of a resilient rubber material, that is frictionally fitted upon the door knob, the stopper 20 incorporating a shock absorber means.

The door knob stopper 20 includes a peripheral side wall 21, for fitting around the outer side of the door knob 22, and the stopper also includes an end wall 23, for abutting against the end or face of the door knob. In the present design, an accordion pleated peripheral wall 24 is formed, integral with the edges of the end wall 23, the accordion pleated peripheral wall 24, at its other end, being integral with an end wall 25, which serves to abut against a wall of the house. Thus, an air chamber 26 is formed between the end walls 23 and 25, and which is ventilated by a vent opening 27. In this design, when the end wall 25 abuts against a wall, the accordion pleated peripheral wall allows the end wall 25 to slowly move toward the end wall 23, so as to compress the central compartment 26. The size of the vent opening 27 is such, that the air from the central chamber 26 cannot rush out all at once, thus resulting in a shock absorbing action, that momentarily slows the travel of the door toward the wall of the room.

In order that the door knob stopper can be grasped and rotated, in order to turn a door knob, without the forward push of the stopper being torsion free, a pair of vanes 28, on the inner side of the end wall 25, slide past opposite sides of a vene 29, formed on a forward side of the end wall 23, the venes 28 and 29 permitting the transmitting of rotational movement between the end walls 23 and 25. Thus, while the forward end of the stopper is axially slidable, it is rotationally rigid, respective to a rear portion of the stopper.

Figure 6:
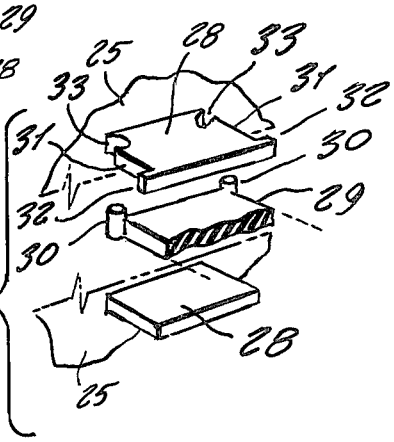
FIG. 6 is an exploded perspective view of a further modified design of the inter-sliding vanes that are shown in FIGS. 4 and 5.

In a further modified design thereof, shown in FIG. 6, the intersliding vanes 28 and 29 further incorporate a means to prevent disengagement of the vanes, in case the stopper is pulled forwardly. Additionally, the vanes incorporate a construction for selectively locking the stopper in a contracted position.

In FIG. 6, the intermediate vane 29 has, at each outward corner, a post 30 integrally formed therewith, and which extends upwardly, so as to slide along opposite side edges 31 of the uppermost vane 28. A sideward extending projection 32, at each outward corner of the uppermost vane 28, serves as a stop, against which the posts 30 abut, thereby preventing disengagement of the intermediate vane from its position between the vanes 28.

The uppermost vane 28 is shown to also include a notch 33, at each of its base corners, the notches serving to selectively receive the upper ends of the posts 30, in case the stopper is intended to be retained in contracted position for any purpose. In a normally cusioning action, the posts 30 will not enter the notches 33. However, when the stopper is intended to be contracted, a person simply squeezes the stopper to a maximum, so that the posts aligned with the openings 33, and the forward portion of the stopper, is then pushed a short distance to either side, so that the vane 29 slides sidewardly respective to the other vanes, and thus one of the posts becomes lodged in one of the notches, and thus retains the stopper in a contracted position.

Thus, modified designs of the invention are provided.

While various changes may be made in the detail construction, it is understood that such changes will be within the spirit and scope of the present invention, as is defined by the appended claims.

What I now claim is:

1. A door knob stopper, comprising, in combination, a one-piece member made of resilient material, forming a hollow cover shaped to enclose a door knob, said member including a compressible bellows on its outward end, for absorbing a shock when said door knob is struck against a wall, and means to prevent axial torque between opposite ends of said bellows, when held in a hand for rotating said knob; said bellows comprising opposite end walls, a first of which comprises an outer end wall of said hollow cover, and an accordian-pleated circular side wall between the peripheral edges of said end walls, and an air vent opening through said side wall, said bellows normally being in an expanded position, so that said bellows enclose a compressible chamber; said means comprising said first end wall having a singular flat vane integral therewith, and projecting into said chamber.

2. The combination as set forth in claim 1, wherein said means further includes said second end wall having a pair of parallel, spaced-apart, flat vanes integral therewith and projecting into said chamber, said vane of the first said end wall being sandwiched between said vanes of the second said end wall.

3. The combination as set forth in claim 2, wherein said vane slidable between said pair of vanes includes a post integral with each outward corner thereof, said posts being extended so to slide along opposite side edges of one of said pair of vanes.

4. The combination as set forth in claim 3, wherein said vane having said posts slided along its opposite side edges includes a sideward projection at each of its outward corners, so as to form stops for said posts.

5. The combination as set forth in claim 4, wherein said vane having said corner projections also includes a notch at each of its base corners, said notches selectively receiving said posts when said second end wall is sidewardly shifted from a longitudinal axis of said first end wall.

* * * * *